US007293826B2

(12) United States Patent
Lu et al.

(10) Patent No.: US 7,293,826 B2
(45) **Date of Patent: *Nov. 13, 2007**

(54) FOLDING CHAIR WITH AN ANTI-PINCHING DEVICE

(75) Inventors: Ming-Chin Lu, Taipei (TW); Chin-Shu Yeh, San-Chong (TW); Hui-Chuan Liang, Taipei (TW); Marian Harding Cochran, Hollywood, FL (US); Daniel Wayne Forbes, Jupiter, FL (US)

(73) Assignee: Atico International USA, Inc., Ft. Lauderdale, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/684,561

(22) Filed: Mar. 9, 2007

(65) Prior Publication Data

US 2007/0164588 A1 Jul. 19, 2007

Related U.S. Application Data

(63) Continuation of application No. 11/061,310, filed on Feb. 18, 2005, now Pat. No. 7,219,955.

(51) Int. Cl.
*A47C 4/00* (2006.01)
*A47D 1/02* (2006.01)

(52) U.S. Cl. ..... 297/58; 297/55

(58) Field of Classification Search ..... 297/16.1, 297/55, 58, 21, 23, 60
See application file for complete search history.

(56) References Cited

U.S. PATENT DOCUMENTS 1,789,295 A 1/1931 Bauer
2,381,574 A 8/1945 Clarin
2,525,876 A * 10/1950 Denney ..... 297/39
2,684,111 A * 7/1954 Adler ..... 297/39
2,692,011 A 10/1954 Hickok
2,708,962 A 5/1955 Rechler
2,757,715 A 8/1956 Hendrickson
4,629,245 A 12/1986 Hardarson
4,772,068 A 9/1988 Gleckler et al.
5,577,799 A 11/1996 St. Germain
5,611,594 A 3/1997 Findlay
5,634,684 A 6/1997 Kojima et al.
5,707,104 A 1/1998 Perego
5,718,474 A 2/1998 Kojima et al.
6,095,597 A 8/2000 Huang (Continued)

*Primary Examiner*—David Dunn
*Assistant Examiner*—Tania Abraham
(74) *Attorney, Agent, or Firm*—Hess Patent Law Firm, PC; Robert J. Hess

(57) ABSTRACT

A folding chair includes first and second parts each having at least one leg, a total number legs of the first and second parts being at least three. A third part of the chair forms a seat and is pivotally connected to the first and second parts. A connecting assembly for pivotally connecting the first part to the second part is a piston assembly having a top end and a bottom end. The top end is pivotally connected to the first part to form a pivot at which the first part pivots relative to the second part between an open position and a closed position. The bottom end is connected to the second part. The connection between the top end and the first part forms the only physical connection between the first and second parts to eliminate cutting dangers to the user.

15 Claims, 12 Drawing Sheets

U.S. PATENT DOCUMENTS 6,279,991 B1 8/2001 Atkings et al.
6,332,646 B1 12/2001 Tseng
6,435,607 B1 8/2002 Liu
6,669,281 B1 12/2003 Huang
6,871,911 B2 3/2005 Alexander, Jr.
2003/0234563 A1 12/2003 Huang
2004/0239153 A1 12/2004 Leng
2006/0071511 A1* 4/2006 Tseng ..... 297/16.1

* cited by examiner

FOLDING CHAIR WITH AN ANTI-PINCHING DEVICE

CROSS-REFERENCE TO RELATED APPLICATION

This application is a continuation of Ser. No. 11/061,311 filed Feb. 18, 2005 now U.S. Pat. No. 7,219,955.

STATEMENT REGARDING FEDERALLY SPONSORED RESEARCH OR DEVELOPMENT n/a

FIELD OF THE INVENTION

The present invention relates to an anti-pinching device for use in a folding chair to serve as a safety device.

BACKGROUND OF THE INVENTION

Folding chairs are used in virtually every location where a large number of people need to gather and sit. Such chairs are used for two primary reasons. First, they are light and easily transported. Second, because they have a folding mechanism, they can collapse into a very compact shape that makes it easy to store and stack.

Conventional folding chairs have four principal parts. Each of these parts can be seen in the folding chair 1 depicted in FIGS. 1 and 2. The first part 10 forms both the front legs 12 and the backrest 14. The second part 20 forms the rear legs 22, and the third part 30 forms the seat. The fourth part 40 is a front leg-to-back leg connection device.

When assembled, the seat 30 is pivotally connected to the first part 10 at a first pivot point 16. The first pivot point 16 can be at any height on the first part 10 but is, typically, somewhere near the midpoint of the first part 10. The seat 30 is also pivotally connected to an upper region 24 of the second part 20 at a second pivot point 26. For stability of the legs 12, 22, both the first and second parts 10, 20 can have transverse beams 18, 28. These beams 18, 28 are optional depending upon the material of the chair 1 and the weight of the user.

The connecting device 40 is provided to limit such movement between a stowed position and an open position in which the chair 1 is used for seating.

The connecting device 40 is pivotally connected to both the first part 10 and the second part 20 at third and fourth pivot points 42, 44, 42', 44', respectively.

In a first embodiment of the connecting device 40' illustrated with dashed lines, the connecting device 40' is merely a solid beam 40'. In the first embodiment, a first tie beam (formed between the respective pivoting connections of the seat 30 and the first and second parts 10, 20) and a second tie beam (formed between the two pivoting connections of the connecting device 40'), together, establish a system that limits movement of the first and second parts 10, 20. Simply put, the first and second parts 10, 20 are limited in movement between a storage position, in which the first and second parts 10, 20 are adjacent and parallel to one another (see, e.g., FIG. 2), and an open position (see, e.g., FIG. 1), in which the first and second parts 10, 20 are at an angle to one another such that the four legs 12, 22 are disposed at a distance from one another (the feet of the legs 12, 22 being disposed along an imaginary square or rectangle), the spacing of the legs 12, 22 being sufficient to support the weight of the user when the user sits upon the seat 30.

In a second configuration of the connecting device 40, also shown in FIG. 1, the connecting device 40 has two halves 46, 48 each respectively connected to one of the first and second parts 10, 20 and an intermediate pivot joint 49 connecting the halves 46, 48. When the chair 1 is collapsed, the pivoting connecting device 40 is in a fully closed position (shown in FIG. 2), in which the two halves 46, 48 form an acute angle (or scissor shape) with respect to the pivot joint 49. When the user extends the pivoting connecting device 40 into a fully open position (shown in FIG. 1), the two halves 46, 48 can be locked (for example, by transverse tabs extending out from the plane of the connecting device 40 from one or both of the halves 46, 48 and preventing the device 40 from opening past the position shown in FIG. 1). Thus, collapse/closing of the chair 1 is not permitted until the user pulls up upon the pivot joint 49. Such upward movement, if sufficiently strong, can catch the user's finger(s) in the scissor-like jaws of the two halves 46, 48, thus, exposing the user to potential injury.

The first and second parts 10, 20 are, typically, formed from circular rods or rectangular columns. Therefore, an area between the first and second parts 10, 20 presents two relatively large pinching surfaces that are not sharp enough to cut a finger(s) disposed therebetween. Instead, the force acting upon the finger is a pressing force that, in some unfortunate cases, can crush a finger disposed therebetween.

In contrast to the crushing surfaces of the parts 10, 12, a typical configuration of the connecting device 40, 40' is a thin, rectangular cross-sectioned bar of metal 40' (or two of such bars 46, 48). Thus, the connecting device 40 presents a relatively thinner surface area that acts, not as a crushing surface, but, rather, as a cutting surface—like the blade of a scissors. The dangers presented by the connecting device 40, 40' are, therefore, axiomatic.

Serious disadvantages exist in the construction of a conventional folding chair 1 shown in FIGS. 1 and 2 because the two tie beam configuration presents a plurality of significant points in which a user can catch his/her finger. These points include both the crushing points—between the first and second parts 10, 20—and the cutting points—between the connecting device 40 and either one of the first and second parts 10, 20. In particular, with the second configuration of the connecting device 40, there exists a very dangerous cutting surface between the "scissors" of the two halves 46, 48. As is evident from the scissor-like construction of the halves 46, 48, if a user has placed a finger(s) between the two halves 46, 48 while closing the chair 1 to its stowed position, there is a serious risk of cutting off the user's finger(s).

Enough experience in the industry of folding chairs has shown that any cutting surfaces are to be avoided if inadvertent finger removal is to be entirely eliminated.

This danger to users is especially true when the folding chair 1 is sized for use by a child. Children typically do not have sufficient experience with using folding chairs and/or do not understand the folding chair mechanism to appreciate the finger-cutting danger and, therefore, to sufficiently avoid this danger. What is needed, therefore, is a chair that can easily fold up for convenient storage and that can be used by children with a minimum amount of pinching surfaces and with no cutting surfaces that can sever off a child's finger(s).

SUMMARY OF THE INVENTION

The present invention provides an anti-pinching device for a folding chair that has no cutting surfaces and that can be used by a child with minimal or no risk of pinching or cutting off the child's finger(s).

With the foregoing and other objects in view, there is provided, in accordance with the invention, a folding chair, including a first part having at least one front leg, a second part having at least one rear leg, a total number of a combination of the at least one front leg and the at least one rear leg being at least three, a third part forming a seat and being pivotally connected to the first and second parts, and a connecting assembly for pivotally connecting the first part to the second part, the connecting assembly being a piston assembly having a top end and a bottom end, the top end being pivotally connected to the first part to form a pivot at which the first part pivots relative to the second part between an open position and a closed position, the bottom end being connected to the second part. Preferably, the first part has a backrest.

With the objects of the invention in view, there is also provided a folding chair, including a front leg assembly, a rear leg assembly, a seat pivotally connected to each of the front and rear leg assemblies, and a piston assembly for connecting the front leg assembly to the rear leg assembly, the piston having a top end pivotally connected to the front leg assembly to form a pivot at which the front leg assembly pivots relative to the rear leg assembly between an open position and a closed position, and a bottom end connected to the rear leg assembly, the piston assembly extending when the front and rear leg assemblies are moved from the open position to the closed position.

With the objects of the invention in view, in a folding chair having a first part having front legs, a second part having rear legs, and a third part forming a seat and being pivotally connected to the first and second parts, there is also provided a connecting assembly for pivotally connecting the first part to the second part including a piston having a top end and a bottom end, the top end being pivotally connected to the first part to form a pivot at which the first part pivots relative to the second part between an open position and a closed position, the bottom end being connected to the second part.

In accordance with another feature of the invention, the connecting assembly is the only connection between the first and second parts.

In accordance with a further feature of the invention, the at least one front leg is two front legs, the at least one rear leg is two rear legs, the first part has a transverse beam between the two front legs, and the second part has a transverse beam between the two rear legs.

In accordance with an added feature of the invention, the connecting assembly has a first shaft, the at least one rear leg is a second shaft, the first shaft is slidably disposed in the second shaft, and the first shaft is pivotally connected to the first part.

In accordance with an additional feature of the invention, there is provided a bushing disposed between the first and second shafts for controlling slidability of the first shaft in the second shaft. Preferably, the bushing is of a material relatively softer than the first and second parts.

In accordance with yet another feature of the invention, there is provided a locking assembly operatively connected to the first and second shafts for selectively securing the first shaft to the second shaft in at least one position.

In accordance with yet a further feature of the invention, the locking assembly longitudinally secures the first shaft to the second shaft in the open position.

In accordance with yet an added feature of the invention, the locking assembly has a bias device and a selectable lock movably connected to the bias device and biased thereby in a given direction, the first shaft has a first bore, the second shaft has a second bore aligned with the first bore in the open position, and the bias device biases the lock into the first and second bores in the open position.

In accordance with yet an additional feature of the invention, the top end has a clevis assembly pivotally connecting the second part to the first part and forming the only physical connection between the first and second parts.

In accordance with again another feature of the invention, the clevis assembly has a lower portion, an upper portion having two flanges, each of the flanges defining a bore, and an axle, the first part has an axle bore, and the axle is disposed through the bore of each of the flanges and through the axle bore to pivotally secure the clevis assembly and the connecting assembly to the first part and form the only physical connection between the first and second parts.

In accordance with again a further feature of the invention, the top end has a clevis assembly having a lower portion connected to the first shaft, an upper portion having two flanges, each of the flanges defining a bore, and an axle, the first part has an axle bore, and the axle is disposed through the bore of each of the flanges and through the axle bore to pivotally secure the clevis assembly to the first part and form the only physical connection between the first and second parts.

In accordance with again an added feature of the invention, the lower portion has a seat limiting travel of the second shaft with respect to the first shaft.

In accordance with again an additional feature of the invention, the clevis assembly is of a material relatively softer than the first and second parts.

In accordance with still another feature of the invention, the second shaft has a longitudinal extent along a longitudinal axis, the lower portion has a longitudinal extent along the axis, and the flanges project from the upper portion in a direction at an angle to the axis.

In accordance with still a further feature of the invention, the flanges are curved and have a portion extending in a direction approximately orthogonal to the axis.

In accordance with still an added feature of the invention, the first part has a lower portion, and the second part has a longitudinal axis lying substantially parallel to the lower portion of the first part and at a distance therefrom when in the closed position.

In accordance with a concomitant feature of the invention, there is provided a spacer connected to a lower portion of at least one of the first and second parts to space the lower portion of the first part from the lower portion of the second part when in the closed position.

Other features that are considered as characteristic for the invention are set forth in the appended claims.

Although the invention is illustrated and described herein as embodied in an anti-pinching device for use in a folding chair, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

Figure 1:
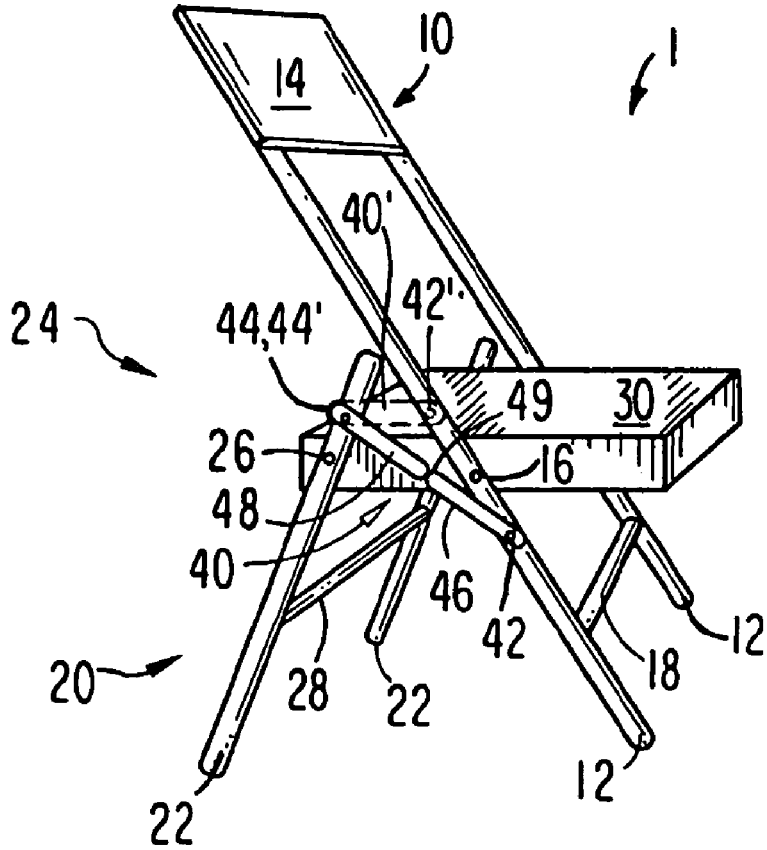
FIG. 1 PRIOR ART
FIG. 1 is an isometric view of a conventional folding chair in an open position.

A more complete understanding of the present invention, and the attendant advantages and features thereof, will be more readily understood by reference to the following detailed description when considered in conjunction with the accompanying drawings wherein:

DETAILED DESCRIPTION OF THE INVENTION

While the specification concludes with claims defining the features of the invention that are regarded as novel, it is believed that the invention will be better understood from a consideration of the following description in conjunction with the drawing figures, in which like reference numerals are carried forward.

Before the present invention is disclosed and described, it is to be understood that the terminology used herein is for the purpose of describing particular embodiments only and is not intended to be limiting. It must be noted that, as used in the specification and the appended claims, the singular forms "a,", "an," and "the" include plural references unless the context clearly dictates otherwise.

Figure 4:
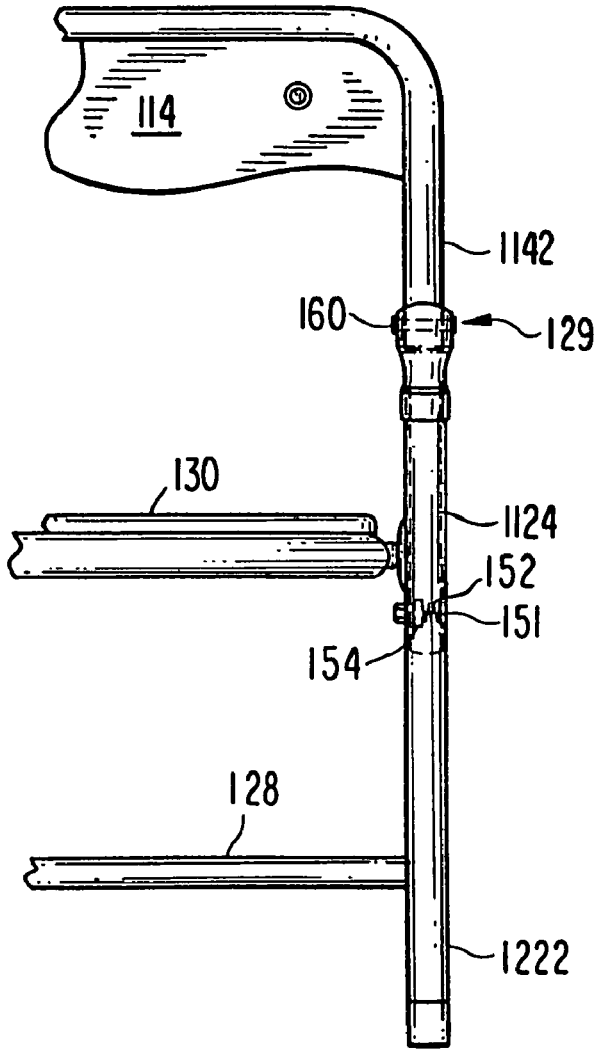
FIG. 4 is a fragmentary, rear view of a connecting assembly of the folding chair of FIG. 3.
Figure 3:
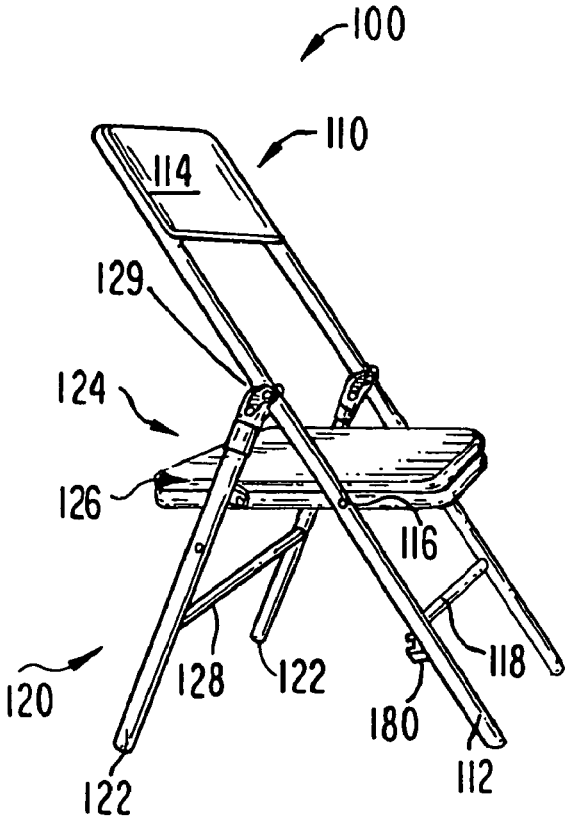
FIG. 3 is an isometric view of an anti-pinching device incorporated into a folding chair according to the invention with the folding chair shown in an open position.
Figure 5:
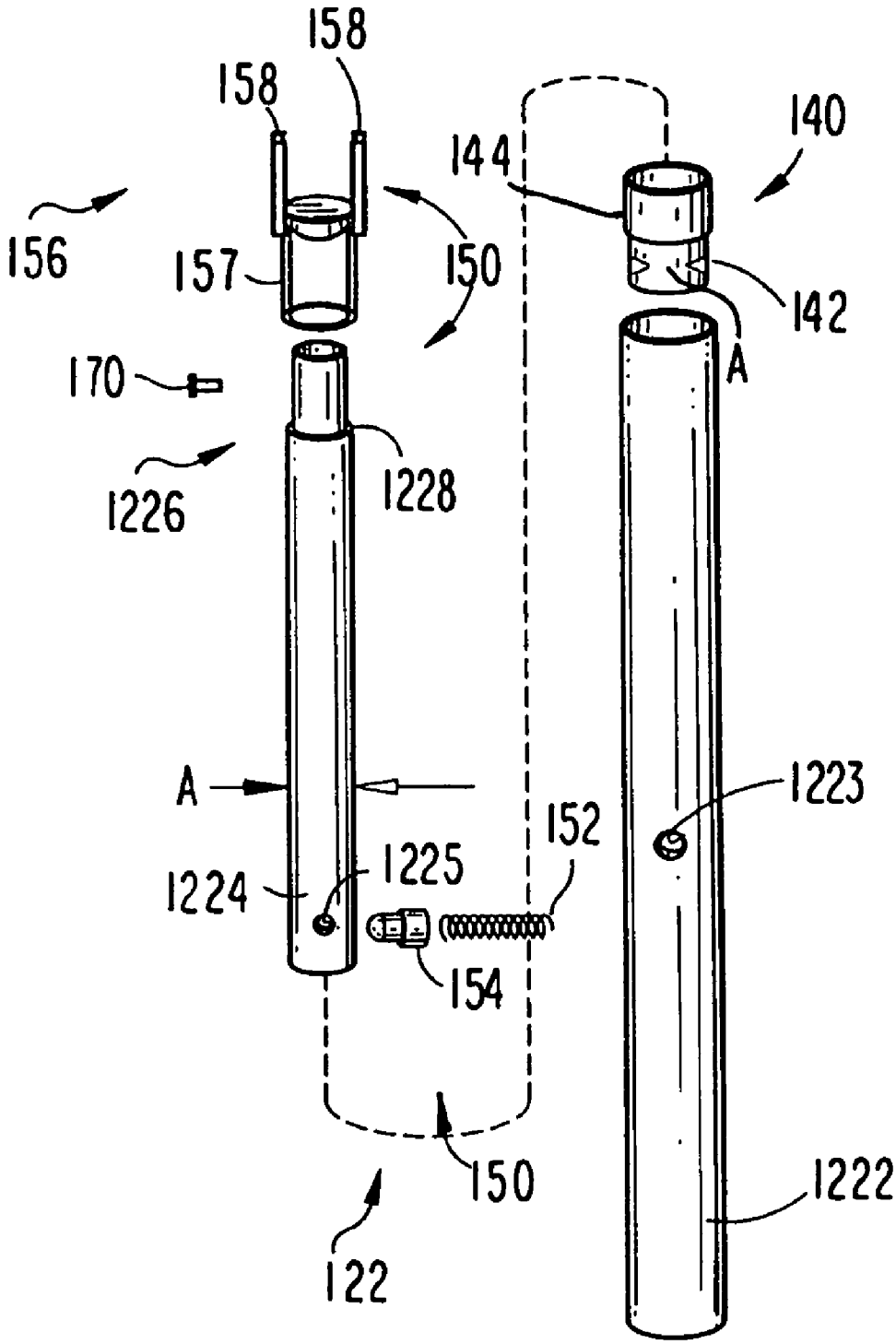
FIG. 5 is an exploded, isometric view of the connecting assembly of the folding chair of FIG. 3.

Referring now to the figures of the drawings in detail and first, particularly to FIGS. 3 to 5 thereof, there is shown a folding chair 100 having an anti-pinching device according to the invention. The folding chair has three principal parts. The first part 110 forms both the front legs 112 and the backrest 114. The second part 120 forms the rear legs 122 and includes a locking connection 124 for locking the first part 110 relative to the second part 120. The third part 130 forms the seat. Unlike prior art folding chairs, there is no separate front leg-to-back leg connection device that presents scissor-like cutting surfaces that can injure a user.

When assembled, the seat 130 is pivotally connected to the first part 110 at a first pivot point 116. The first pivot point 116 can be at any height on the first part 110 but is, typically, somewhere near the midpoint of the first part 110. The seat 130 is also pivotally connected at an upper region 124 of the second part 120 at a second pivot point 126 (which cannot be seen in FIG. 3 because it is on the inside surface of the rear leg 122). For stability of the legs 112, 122, both the first and second parts 110, 120 can have transverse beams 118, 128. These beams 118, 128 are optional depending upon the material of the chair 100 and the weight of the user.

In the configuration according to the present invention, the upper-most end of the second part 120 is pivotally connected to the first part 110 at a third pivot point 129. The structure of the connection between the locking connection 124 and the third pivot point 129 may be seen clearly in FIGS. 4 and 5. FIGS. 4 and 5 only show one of the two legs 122 because they are of similar construction.

Each leg 122 of the second part 120 is formed from two separate shafts 1222 and 1224. Specifically, as shown in FIG. 4, the outer shaft 1222 forms the visible portion of the leg 122. The inner shaft 1224 is nested slidably in the outer shaft 1222. A bushing 140, shown in the exploded view of FIG. 5, is inserted at the upper end of the outer shaft 1222. The bushing 140 has a mushroom shape and, therefore, includes a trunk portion 142 and a head portion 144. Both the trunk and head portions 142, 144 of the bushing 140 define an interior bore having a constant inner diameter A for receiving slidably therein the inner shaft 1224.

The outer diameter of the trunk portion 142 corresponds substantially to the inner diameter of the at least partially hollow outer shaft 1222. Therefore, the bushing 140 can merely be press-fitted into the open top end of the outer shaft 1222. It is preferable for the bushing to be formed from a relatively softer material than the inner and outer shafts 1222, 1224. Therefore, the outer diameter of the trunk portion 142 can be slightly larger than the inner diameter of the outer shaft 1222 so that the bushing 140, after being pressed into the outer shaft 1222, cannot be removed from the outer shaft 1222 without application of a substantial external force (such a force being greater than any frictional forces that will occur between the shafts 1222, 1224 during normal use). Also, forming the bushing 140 from a softer material allows the bushing 140 to absorb any frictional forces that are produced when the inner shaft 1224 slides in and out of the outer shaft 1222. Preferably, the bushing is made of polypropylene.

The configuration of the present invention allows the inner shaft 1224 to be slidably but snugly held in the bushing 140 and allows the lower portion of the inner shaft 1224 to extend into and out from the inside of the outer shaft 1222.

The outer diameter of the bushing 140 can be of any size but, preferably, is close in size to the outer diameter of the outer shaft 1222. To prevent the bushing 140 from sliding within the outer shaft 1222, the outer diameter of the head portion 144 is up to approximately 25% greater than the outer diameter of the outer shaft 1222.

To prevent the inner shaft 1224 from retreating into the outer shaft 1222 too far, or to set a particular locking distance of the inner shaft 1224 at a given point in the outer shaft 1222, a locking assembly 150 is provided inside the shafts 1222, 1224. The locking assembly 150 includes a bias device 152 (preferably, in the form of a spring) and a removable lock 154 (preferably, in the form of a push-button). The measures for locking the inner shaft 1224 in a defined position within the outer shaft 1222 utilizing the assembly 150 include providing a first bore 1223 in the outer shaft 1222 and a second bore 1225 in the inner shaft 1224. As shown particularly well in the hidden view of FIG. 4, after the locking assembly 150 is placed in the inner shaft 1224 so that the lock 154 protrudes from the second bore 1225 and the combined assembly 1224, 150 is placed through the bushing 140 and inside the outer shaft 1222, the lock 154 will automatically exit the first bore 1223 when it is aligned with the first bore 1223. It is noted that neither the inner shaft 1224 nor the outer shaft 1222 rotate relative to one another because, for example, the transverse beam 128 is connected fixedly to both legs 122. Therefore, alignment of the lock 154 with the first bore 1223 is guaranteed.

Rotational stability of the inner shaft 1224 is guaranteed by the configuration of the connection between the inner shaft 1224 and the first part 110. As shown in FIGS. 4 and 5, a clevis 156 and an axle 160 form this connection.

In particular, the clevis 156 has a lower portion 157 and an upper portion, the upper portion having two flanges 158. The lower portion 157 is, preferably, a hollow cylinder having an outer diameter and an inner diameter. The inner diameter of the lower portion 157 is sized to fit therein an upper-most end 1226 of the inner shaft 1224. To create this form fit, the upper-most end 1226 has a smaller outer diameter than the outer diameter of the remainder of the inner shaft 1224. This change in diameter, therefore, creates a seat 1228. If the inner diameter of the lower portion 157 of the clevis 156 is sized to fit on the end 1226 of the inner shaft 1224, then the seat 1228 can be used to limit the travel of the lower portion 157 onto the end 1226. Preferably, the clevis 156 is of the same relatively softer material as the bushing 140. Accordingly, if the inner diameter of the lower portion 157 is slightly smaller than the outer diameter of the end 1226, then the clevis 156 can be pressed upon the end 1226 so that it remains in place. Additionally, and/or alternatively, a fastener 170 (such as a screw) can be used to fix the clevis 156 in place (both longitudinally and rotationally) to the inner shaft 1224. The inner shaft 1224 can be provided with a non-illustrated screw hole for receiving the screw 170.

The outer diameter of the lower portion 157 can be of any size. The outer diameter, however, should be greater than the width A of the opening in the bushing 140 so that the clevis 156 does not enter the opening from a top side thereof. It is preferable to have the outer diameter be no more than 25% larger than the outer diameter of the lower portion of the inner shaft 1224.

The upper portion of the clevis 156 has two flanges 158, each defining a bore for receiving the axle 160 therethrough. After the clevis 156 and the inner shaft 1224 are connected to one another and inserted into the bushing 140 and the outer shaft 1222 as shown in FIG. 4, the axle 160 is threaded through a first flange 158, through the tube 1142 extending downward from the backrest 114 and forming the front leg 112, and through the second flange 158. The axle 160 is, then, fastened in any conventional manner. Such a configuration, therefore, produces a pivot joint between the rear leg 122 and the front leg 112.

If there is a need to anchor the locking assembly 150 inside the inner shaft 1224 to prevent inadvertent removal of the locking assembly 150, then a protrusion 151 can be formed directly opposite the second bore 1225. See FIG. 4. In such a case, the locking assembly 150 is compressed, the bias device 152 is positioned on the protrusion 151, and, then, the assembly 150 is allowed to expand and seat the lock 154 inside the second bore 1225.

The photographs of FIGS. 6 to 17 show various views of the folding chair 100 according to the invention.

Figure 6A:
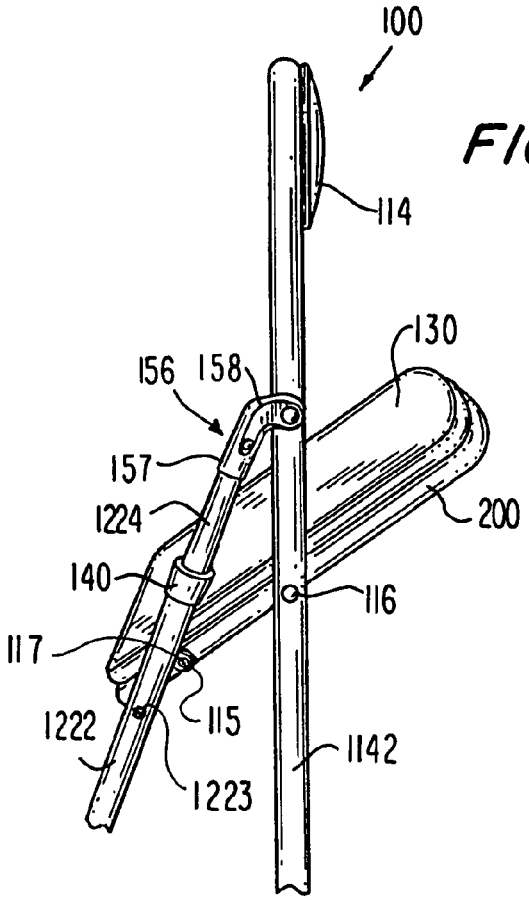
FIGS. 6A and 6B are isometric views of anti-pinching devices incorporated into two folding chairs according to the invention from a side thereof, one of the chairs being in the open position and the other of the chairs being in a position between the open and closed positions in which the connecting assembly is partially exposed.
Figure 6B:
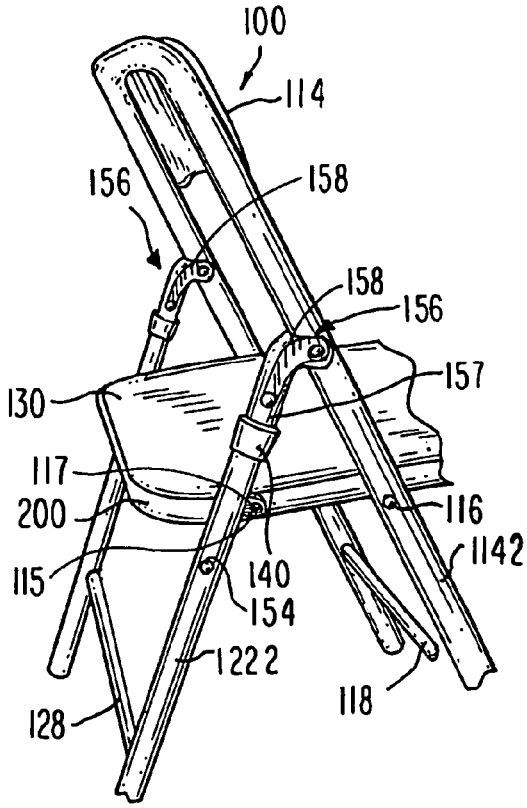
Figure 7:
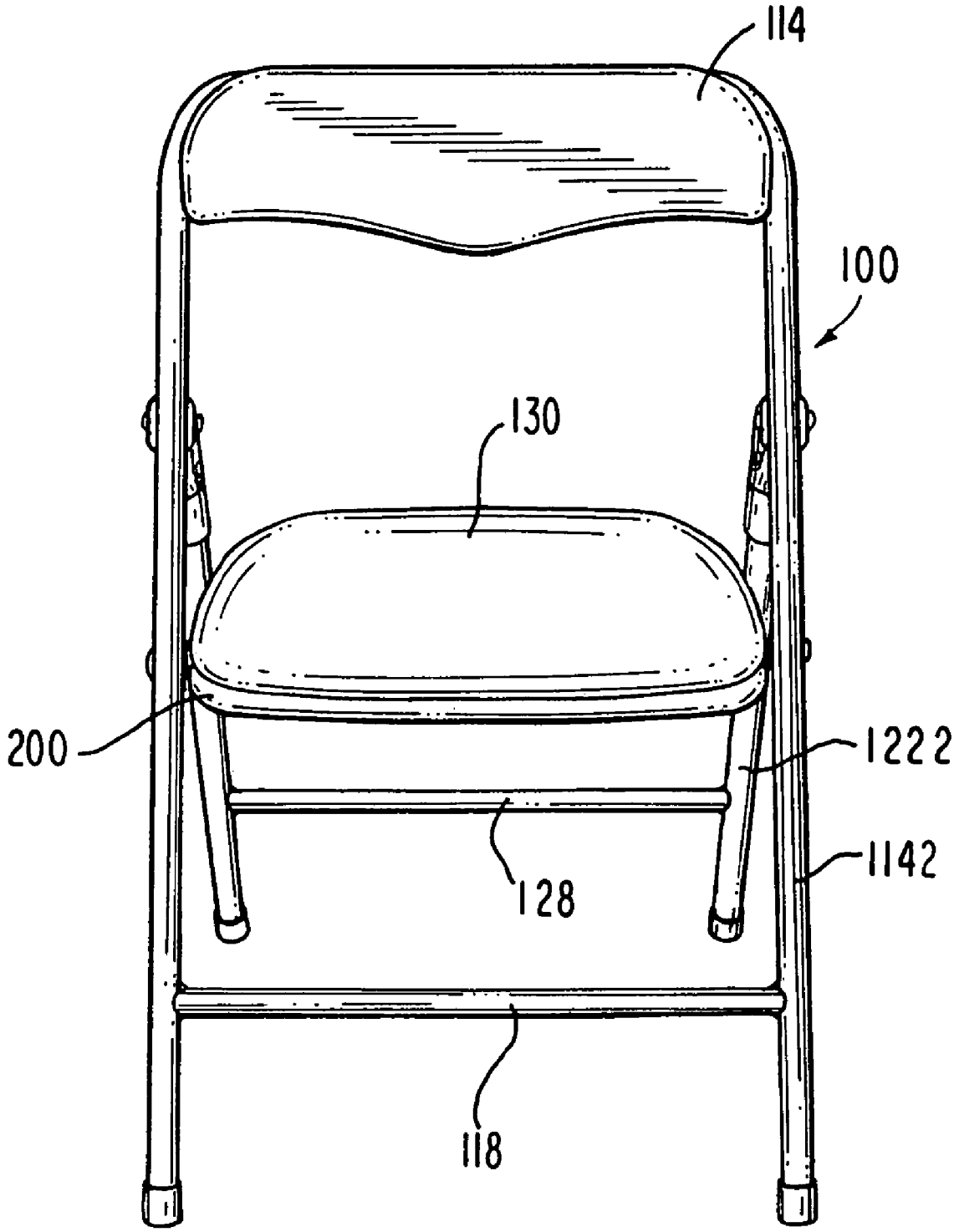
FIG. 7 is an isometric view of one chair of FIG. 6 from a front side thereof in the open position.
Figure 8:
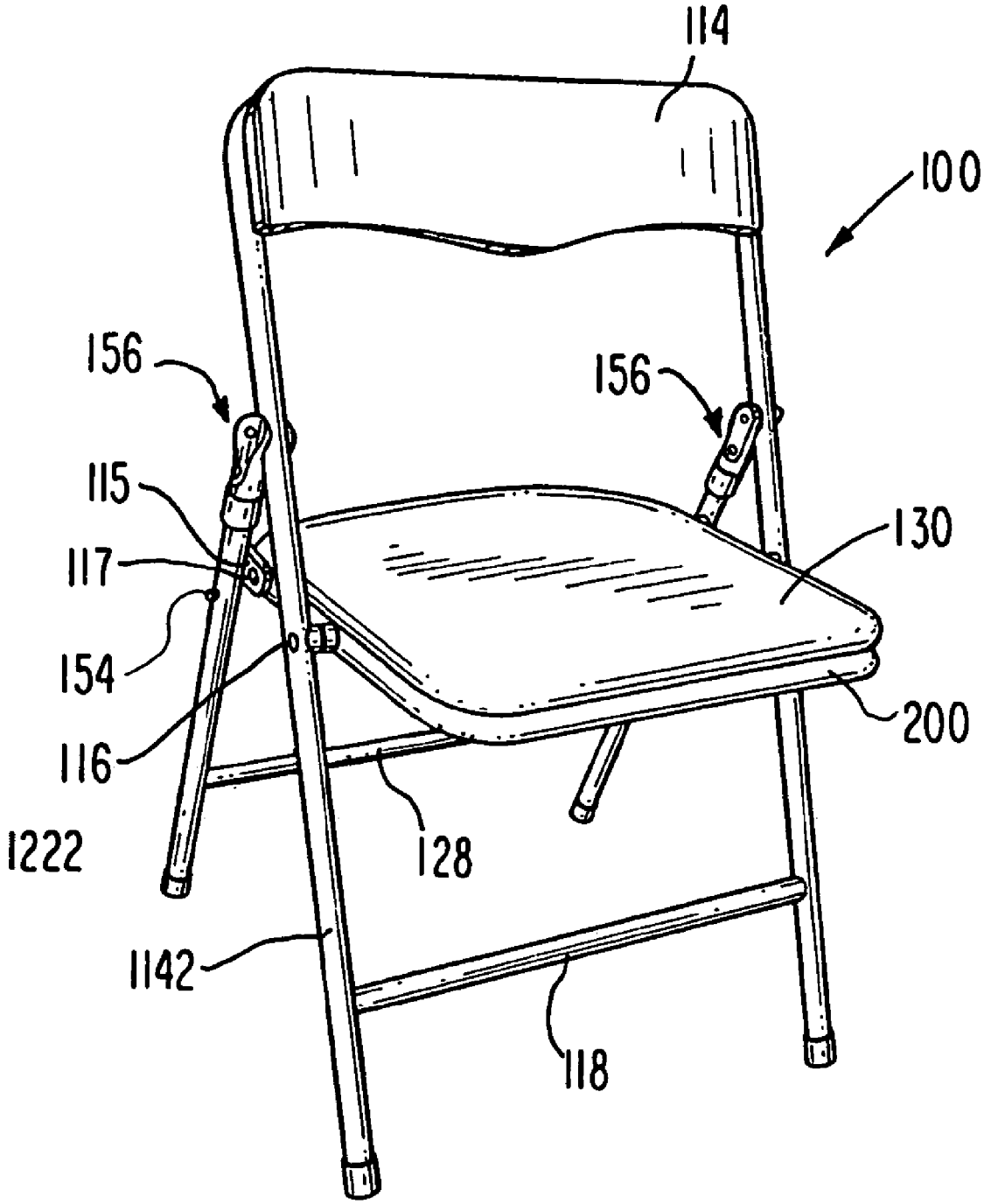
FIG. 8 is an isometric view of the chair of FIG. 7 rotated approximately 45 degrees.
Figure 9:
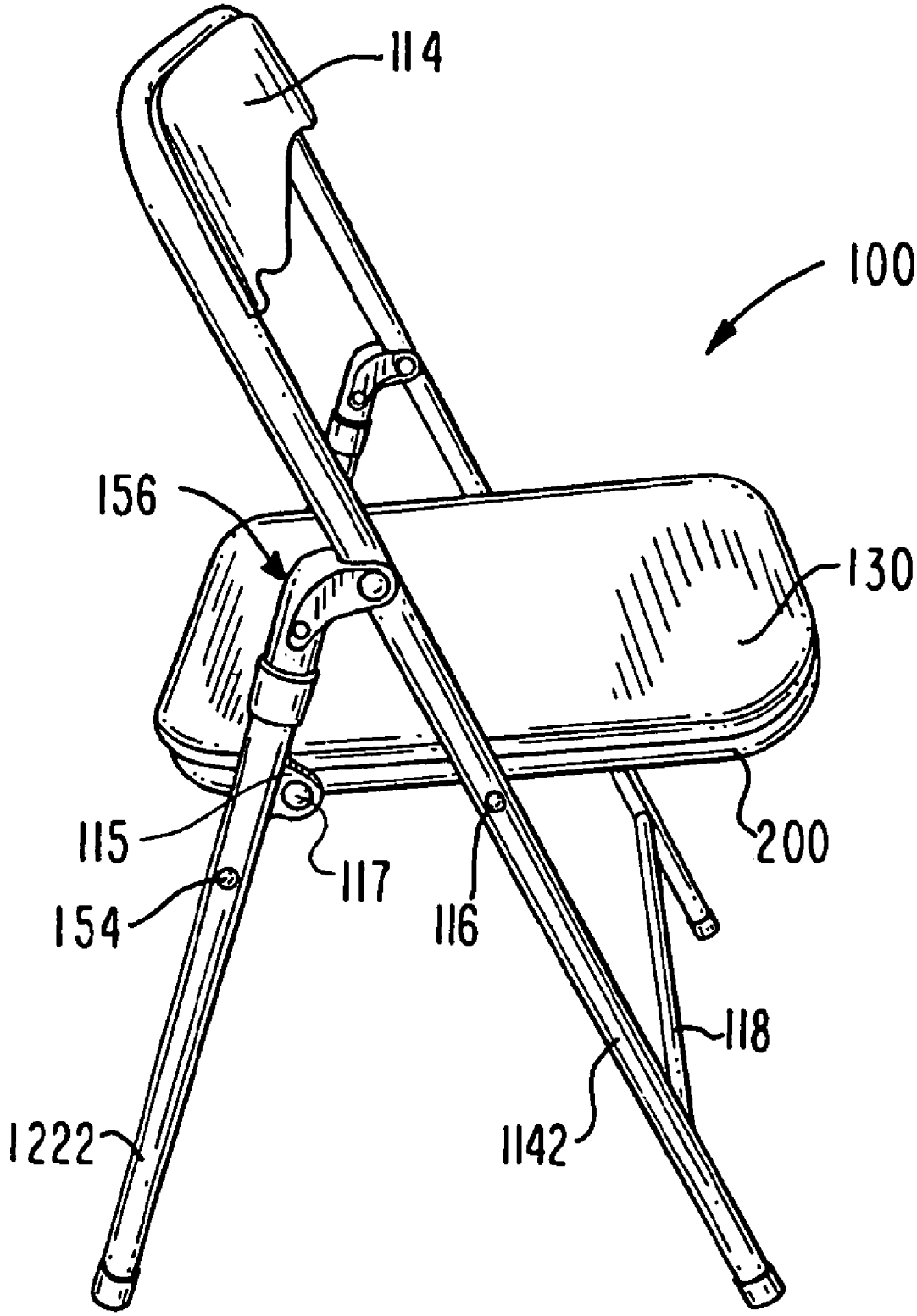
FIG. 9 is an isometric view of the chair of FIG. 7 rotated approximately 90 degrees.

FIG. 6A shows a folding chair according to the invention in an intermediate position between the open and closed positions and FIG. 6B shows a folding chair according to the invention in the open position. The chair 100 of FIG. 6A, therefore, clearly shows the inner shaft 1224 extended partially out of the bushing 140.

FIGS. 6A and 6B illustrate the novel connection of the present invention. When the folding chair 100 is in the open position, the top surface of the bushing 140 hits the lower surface of the clevis 156, in particular, the lower surface of the lower portion 157. The hitting of these two surfaces forms a stop that defines the open position of the legs 112, 122. As the folding chair 100 is closed, the outer shaft 1222 is pulled from the inner shaft 1224 and the two shafts 1222, 1224 begin to move as a piston assembly. Such an assembly is viewed clearly by the left chair 100 in FIG. 6 and the chair 100 in FIG. 14. FIGS. 6A and 6B also show the features of the side view of the flanges 158. The flanges 158 do not project in a direction along the longitudinal extent of the shafts 1222, 1224. Instead, they are curved and extend in a direction somewhat orthogonal to the longitudinal extent of the shafts 1222, 1224. The curved extension of the flanges 158 can be at any angle with regard to the tubes 1222, 1224. A preferred angle is approximately 90 degrees. The shaft 1222 is pivotally secured to the seat frame 200 by a rivet 117 passing through an opening in a connector 115.

Figure 10:
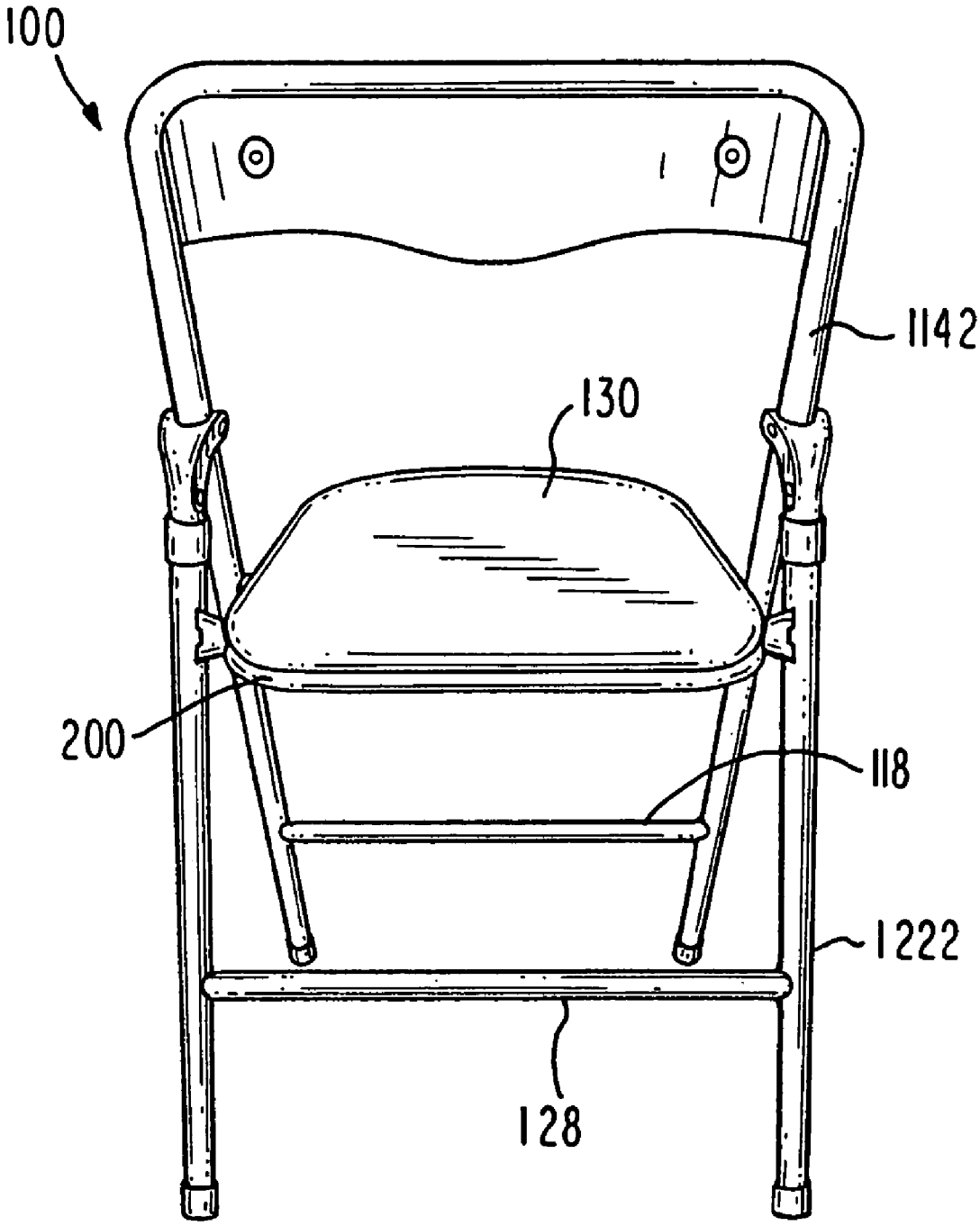
FIG. 10 is an isometric view of the chair of FIG. 7 rotated approximately 180 degrees to show the rear side thereof.

FIGS. 7, 8, 9, and 10 show the chair 100 from a front side thereof in the open position and rotated approximately 45, 90, and 180 degrees. FIG. 10 shows the rear side of the chair 100.

Figure 11:
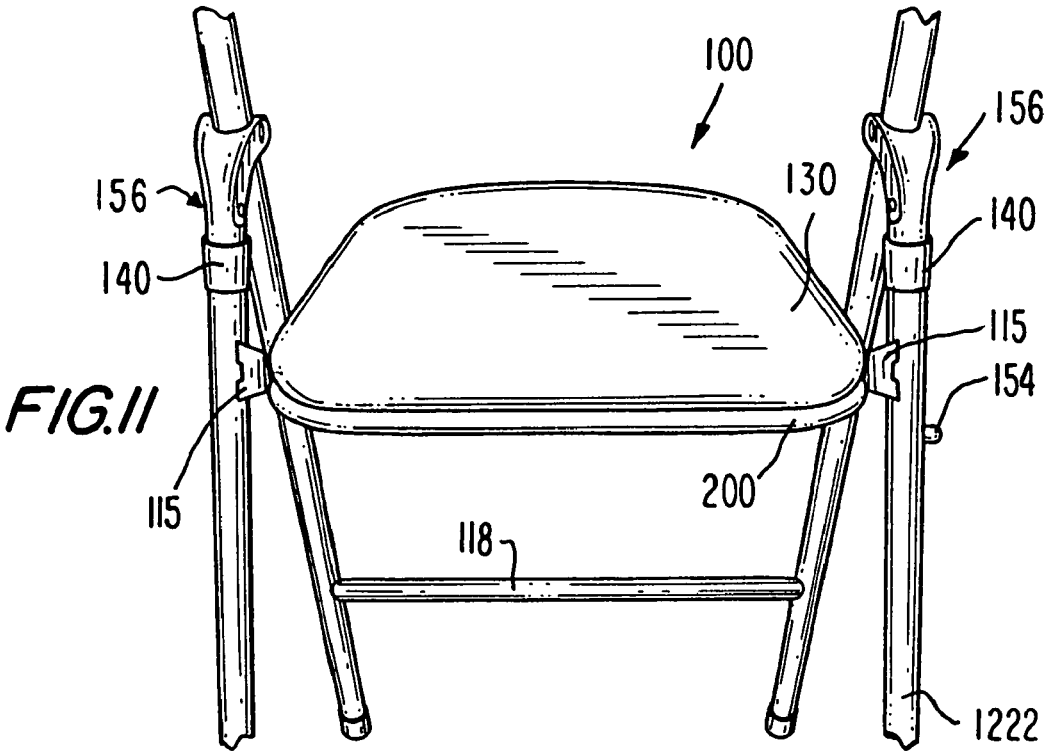
FIG. 11 is an isometric view of an enlarged portion of the chair of FIG. 10.
Figure 12:
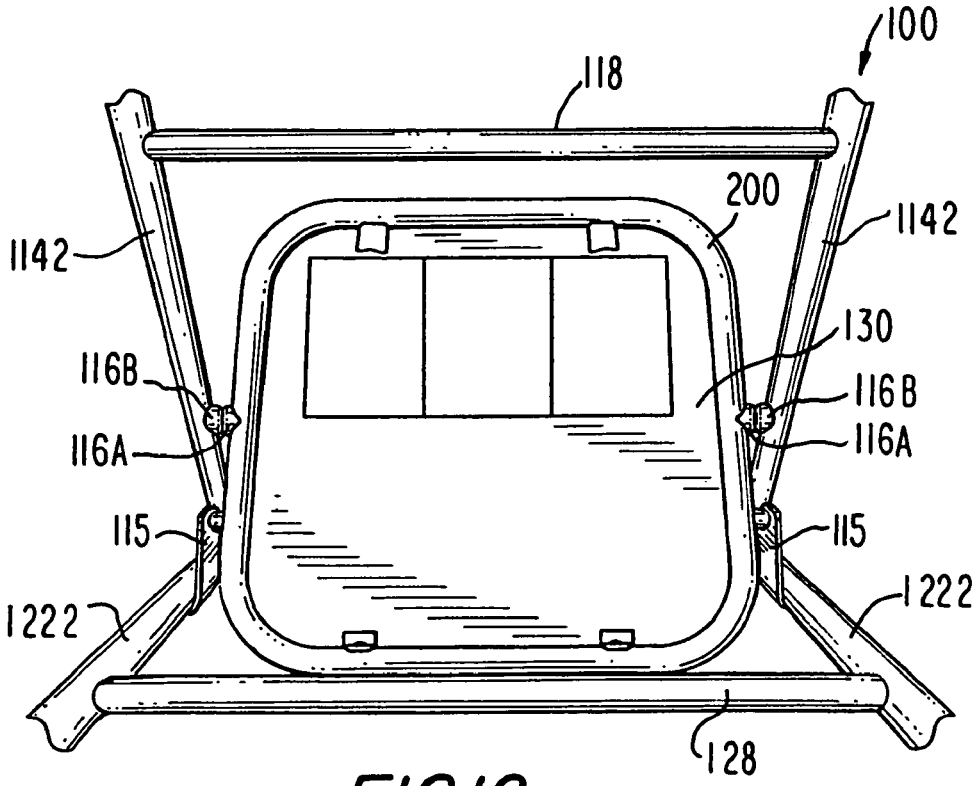
FIG. 12 is an isometric view of the bottom of the chair of FIG. 7 viewed from underneath the chair.

FIG. 11 is an enlarged view from behind the chair. FIG. 12 is an enlarged view from the bottom of the chair 100. It shows a seat frame 200 that extends about a periphery beneath a seat overlay that together form an assembly of the seat 130. The first pivot point 116 (FIG. 8) is exemplified by rivet that may pass through two protruding portions 116A, 116B (FIG. 12) with one (116A) protruding outwardly from the seat frame 200 while the other (116B) protrudes toward the protruding portion 116A to engage same from the tube 1142.

Figure 13:
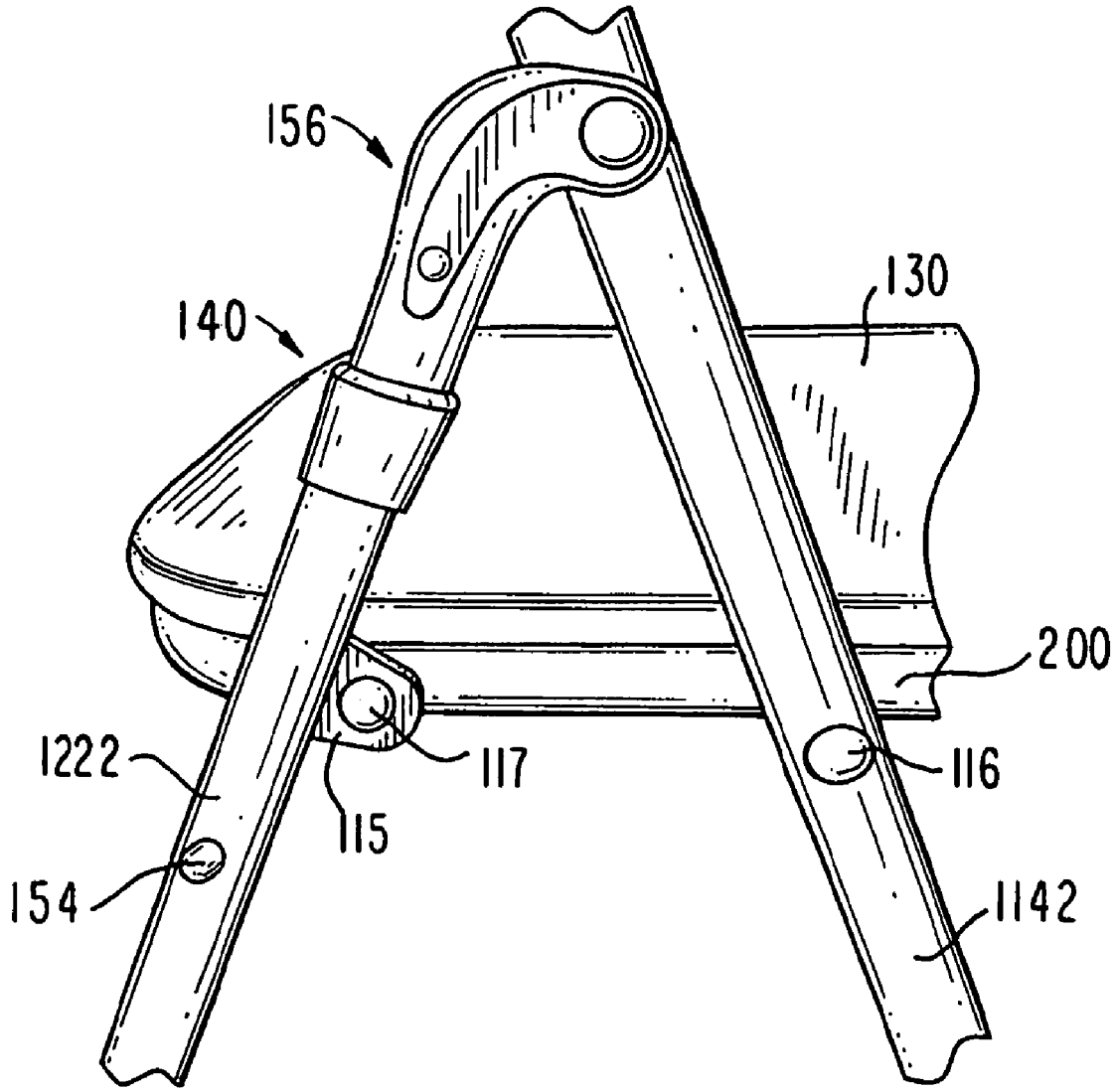
FIG. 13 is an isometric view of an enlarged portion of the chair of FIG. 9.
Figure 14:
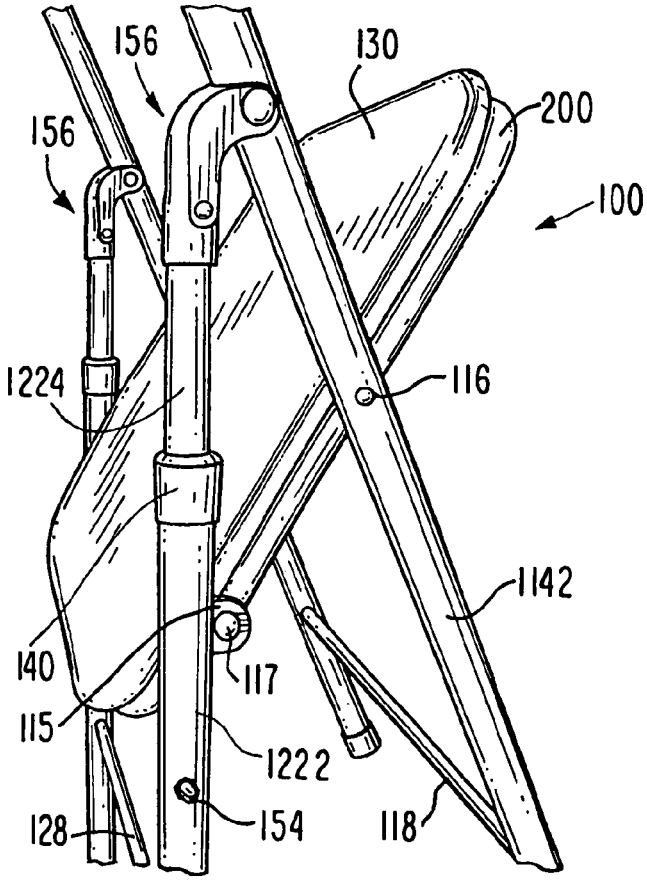
FIG. 14 is an isometric view of an enlarged portion of one of the chairs of FIG. 6 rotated approximately 5 to 15 degrees.

FIG. 13 shows the clevis 156, the bushing 140, and the outer shaft 1222 from the side thereof and in the open position of the chair. In contrast, FIG. 14 shows the clevis 156, the bushing 140, and the outer shaft 1222 in a partially closed position in which the inner shaft 1224 is visible.

Figure 15:
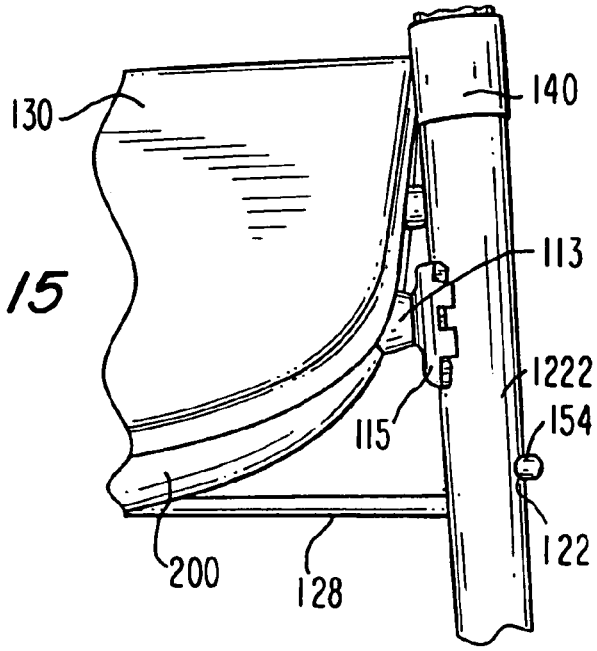
FIG. 15 is an isometric view of an enlarged portion of the chair of FIG. 10.

FIG. 15 clearly shows the lock 154 protruding from the second bore 1225 in the outer shaft 1222.

Figure 16:
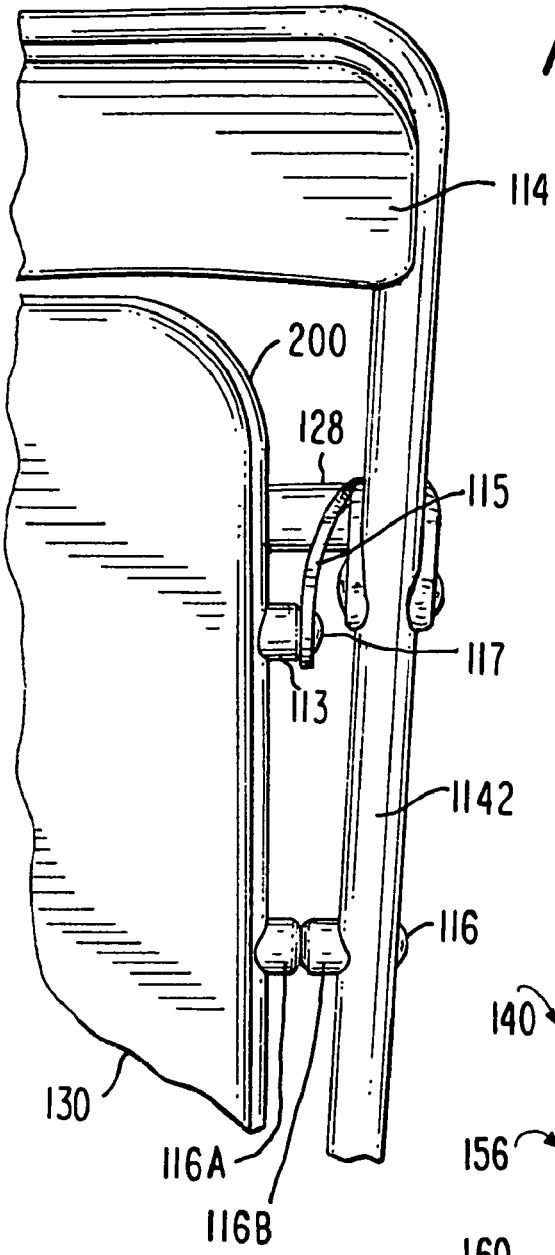
FIG. 16 is an isometric view of an enlarged portion of the chair of FIG. 7 viewed from above and faced downward along the seatback and front leg.
Figure 17:
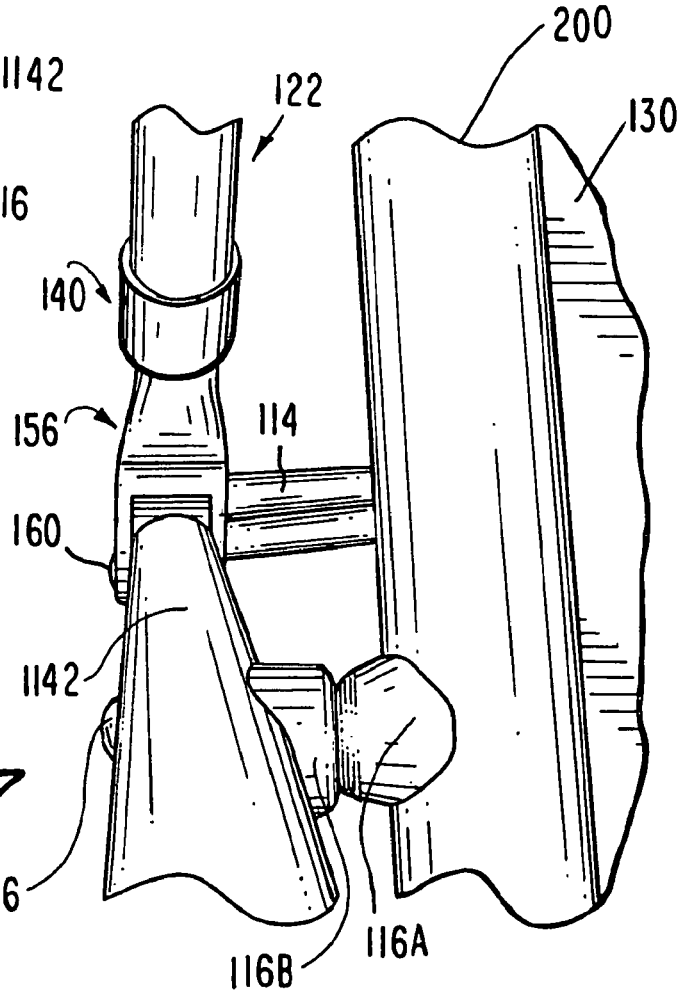
FIG. 17 is an isometric view of an enlarged portion of the chair of FIG. 7 viewed from below the seat and faced upward along the front leg.

FIGS. 16 and 17 show the axle 160 connecting the clevis 156 to the tube 1142, both from above and below the clevis 156.

As can be seen from FIGS. 6A, 6B to 17, the curved nature of the connector assembly—including the inner shaft 1224 and the clevis 156—places the rear leg 122 away from the front leg 112 when the chair 100 is in the closed/stored position. The curved shape of the flanges 158 of the clevis 156 project the inner shaft 1224 away from the front leg 112. However, when in the closed position, the front leg 112 and the rear leg 122, while parallel to one another, are at a distance from one another that still can pose a danger of crushing between the two legs 112, 122.

Two variations of the connection assembly can be applied to move the rear leg 122 in a position that is further away from the front leg 112 when the chair 100 is closed. A first embodiment can increase the length of the orthogonal portion of the flanges 158 as compared to the length shown in FIGS. 6 and 14. If an average width of a finger is determined to be equal to B, then this length can be extended at least by B. For example, length B can be between ¾" to 1". In such a configuration, when the chair 100 is in the closed/stored position, the rear leg 122 is far enough away from the front leg 112 to prevent any injury to fingers because there are no crushing surfaces close enough to one another to catch a finger therebetween. A second variation for moving the legs 112, 122 away from one another includes adding a bumper 180 to one or both of either the front legs 112 or the rear legs 122. A diagrammatic illustration of the bumper 180 is shown in FIG. 3, for example. The bumper 180 is, preferably, a relatively soft and cushioning material, such as rubber. The bumper 180 can take any shape. However, a preferred shape includes two sides and a central indentation having a shape corresponding to the outer shape of the rear leg(s) 122. In such a configuration, the rear leg 122 will fit snugly in the indentation. Of course, these two variations can be combined to insure that the crushing surfaces are no longer present.

It is noted that for a folding chair sized to fit a child, a preferred outer diameter of the outer shaft 1222 is 16 mm and outer diameter of the inner shaft 1222 is 13 mm. A preferred outer diameter of the upper-most end 1226 of the inner shaft 1224 is 10 mm.

In an alternative non-illustrated embodiment of the present invention, the chair can have three legs. In one variant, there are two rear legs and one front leg and, in another variant, there is one rear leg and two front legs. In the first variant, each rear leg has the piston of the connecting assembly and the pistons move correspondingly when the chair is folded closed or opened. In the second variant, there is only one piston.

Figure 2:
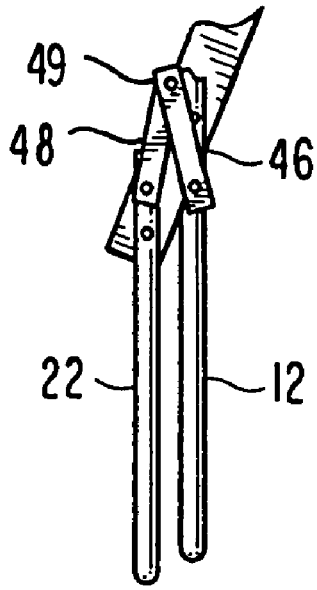
FIG. 2 PRIOR ART
FIG. 2 is an enlarged side elevational view of a portion of the chair of FIG. 1 in a closed/stowed position.

The configurations according to the present invention, therefore, do not have any thin, rectangular cross-sectioned bar or bars of metal 40, 40'. Accordingly, no thin surface areas exist that can act as a cutting surface. As such, the cutting dangers presented by prior art folding chairs are entirely eliminated. In some embodiments of the present invention, the crushing dangers are eliminated as well, making the folding chair safer than chairs of the prior art. Simply put, the serious disadvantages presented by the conventional folding chair 1 as shown in FIGS. 1 and 2 are not present in the invention of the present application.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A folding chair with an anti-pinching device, comprising: a seat frame assembly; a front leg assembly, a rear leg assembly that includes a rear leg shaft; an anti-pinching device assembly, the anti-pinching device assembly including a clevis assembly and a further shaft, the further shaft being arranged to slide within the rear leg shaft, the clevis assembly being secured to the further shaft and pivotally connected to the front leg assembly; the rear leg assembly and the seat frame assembly being pivotally connected to the each other via a connecting pivot assembly, the front leg assembly and the seat frame assembly being pivotally connected to each other via a further pivot assembly, the further shaft having two portions of different diameters with a seat transitioning between the two portions, the clevis assembly being fitted onto the portion of the further shaft whose diameter is smaller than that of the other portion so as to limit travel of the clevis assembly relative to the further shaft.

2. The folding chair with the anti-pinching device of claim 1, further comprising a bushing disposed between the rear leg shaft and the further shaft to control an extent of sliding of the further shaft relative to the rear leg shaft by providing a snug fit between the bushing and the further shaft.

3. The folding chair with the anti-pinching device of claim 2, further comprising a blocking assembly arranged to block continued sliding movement of the further shaft relative to the rear leg shaft as the front and rear leg assemblies reach a folded open position, the blocking assembly including the bushing and a seat that are arranged to limit the sliding movement by engaging each other as the further shaft and the rear leg shaft reach the folded open position.

4. The folding chair with the anti-pinching device of claim 1, wherein the front leg assembly includes a backrest.

5. The folding chair with the anti-pinching device of claim 1, wherein the front leg assembly includes two front legs and the rear leg assembly includes two rear legs, one of the two rear legs including the rear leg shaft, further comprising a transverse beam between the two front legs and a further transverse beam between the two rear legs.

6. The folding chair with the anti-pinching device of claim 1, wherein the clevis assembly has two portions with one of the two portions having two flanges that project from a remainder of the one portion, the flanges each defining a respective bore, and an axle disposed through each of the respective bores and through an axle bore in the front leg assembly to pivotally secure the clevis assembly o the front leg assembly.

7. The folding chair with the anti-pinching device of claim 1, wherein the clevis assembly is of a material softer than that of the front and rear leg assemblies.

8. The folding chair with the anti-pinching device of claim 1, wherein the other of the two portions is elongated in a direction of elongation, the flanges being configured to project from the remainder in a direction angled relative to the direction of elongation of the other of the two portions.

9. The folding chair with the anti-pinching device of claim 8, wherein the flanges are curved to extend in a direction approximately orthogonal to the direction of elongation of the other of the two portions.

10. The folding chair with the anti-pinching device of claim 1, wherein the front and rear assemblies are each elongated with respective axes passing through their respective directions of elongation, the front and rear assemblies being arranged so that when in a folded closed position, the respective axes are substantially parallel to each other.

11. The folding chair with the anti-pinching device of claim 1, further comprising a spacer connected to at least one of the front and rear leg assemblies and positioned to space apart same as same reach the folded closed position.

12. The folding chair with the anti-pinching device of claim 11, wherein the spacer has an indentation into which fits the other of the front and rear leg assemblies as the front and rear leg assemblies reach the closed position.

13. The folding chair with the anti-pinching device of claim 1, further comprising a locking assembly arranged to releasably lock the further shaft and the rear leg shaft to each other in at least one relative position, the locking assembly having a lock and a bias device arranged to bias the lock in a direction, each of the further shaft and rear leg shaft having respective bores that align with each other as the front and rear leg assemblies reach a folded open position, the locking assembly being arranged so that the bias device biases the lock into the respective bores as the respective bores align with each other.

14. A folding chair with the anti-pinching device of claim 1, wherein the connecting pivot assembly includes a connector secured to the rear leg assembly and pivotally connected to the seat frame.

15. A folding chair with the anti-pinching device of claim 14, wherein the connector is elongated to extend in a direction from the rear leg shaft towards the front leg assembly to a pivot location with the seat frame.

* * * * *